US005554060A

United States Patent [19]

Koishikawa et al.

[11] Patent Number: 5,554,060

[45] Date of Patent: Sep. 10, 1996

[54] OUTBOARD ENGINE STRUCTURE

[75] Inventors: Kouji Koishikawa; Masaki Tsunoda; Hitoshi Suzuki, all of Wako, Japan

[73] Assignee: Honda Giken Kogyo Kabushiki Kaisha, Tokyo, Japan

[21] Appl. No.: 357,515

[22] Filed: Dec. 16, 1994

[30] Foreign Application Priority Data

Dec. 18, 1993 [JP] Japan ..... 5-343910

[51] Int. Cl.[6] ..... B63H 21/32

[52] U.S. Cl. ..... 440/89; 440/900; 440/88

[58] Field of Search ..... 60/298, 302, 310; 123/195 D, 196 R, 196 W; 440/76, 78, 88, 89, 900

[56] References Cited

U.S. PATENT DOCUMENTS

| | | | |
|---|---|---|---|
| 5,215,164 | 6/1993 | Shibata | 123/196 W |
| 5,231,958 | 8/1993 | Takahashi et al. | 440/89 |
| 5,239,825 | 8/1993 | Shibata | 60/302 |
| 5,433,634 | 7/1995 | Nakayama et al. | 60/299 |

FOREIGN PATENT DOCUMENTS

| | | | |
|---|---|---|---|
| 4234682A1 | 6/1993 | Germany . | |
| 4301286A1 | 7/1993 | Germany . | |
| 3023308 | 1/1991 | Japan | 60/302 |
| 404297393 | 10/1992 | Japan | 440/88 |

OTHER PUBLICATIONS

Patent Abstracts of Japan, vol. 12, No. 400 (M-756), Oct. 24, 1988 & JP-A-63 143332, Jun. 15, 1988.

*Primary Examiner*—Edwin L. Swinehart
*Attorney, Agent, or Firm*—Nikaido Marmelstein Murray & Oram LLP

[57] ABSTRACT

An outboard engine structure is provided including an engine mounted in an upper portion of the structure, wherein an exhaust gas from the engine is passed through an exhaust passage located vertically within an engine body case, into a lower portion of the case and discharged into water. A catalytic converter is positioned adjacent an oil pan the said engine. The oil pan is mounted in a suspended manner in an upper area within the engine body case and the catalytic concerted is incorporated in the middle of the exhaust passage. The catalytic converter is fixed to and supported on the oil pan. Thus, it is easy to place the catalytic converter in the engine body case.

15 Claims, 6 Drawing Sheets

OUTBOARD ENGINE STRUCTURE

BACKGROUND OF THE INVENTION

1. Field of the Invention

The present invention relates to an outboard engine structure detachably mounted at the stern of a boat or ship for propelling the same, and more particularly, to an exhaust system for an engine mounted on the outboard engine structure.

2. Description of the Prior Art

In general, an outboard engine structure is constructed such that an engine having a crankshaft disposed vertically therein is mounted at an uppermost portion of an outboard engine structure body case whose lower portion is submerged in water. An output from the engine is transmitted to a propeller shaft through a drive shaft provided in a suspended manner within the engine body case to rotate the propeller, as described in, for example, Japanese Utility Model Application Laid-Open No. 93597/76.

Exhaust gas from the engine is passed through an exhaust passage located vertically within the engine body case, into a lower portion of the case and discharged into water.

In such an outboard engine structure, if an exhaust emission control catalytic converter is mounted in an exhaust system for purification, it is difficult to place and support the catalytic converter, because the exhaust passage is located within the engine body case, as described above, and the engine body case is formed into a narrow configuration in order to reduce the underwater resistance of the submerged portion of the engine body case and to reduce the weight of the engine body case.

SUMMARY OF THE INVENTION

It is an object of the present invention to provide an outboard engine structure including a catalytic converter mounted in an exhaust system, wherein the above difficulty is overcome.

To achieve the above object, according to the present invention, there is provided an outboard engine structure comprising an engine mounted in an upper portion of the structure, wherein exhaust gas from the engine is passed, through an exhaust passage located in a vertical direction within the engine body case, into a lower portion of the engine body case and is discharged into water. The engine includes an oil pan mounted in a suspended manner within the engine body case at an upper portion thereof, and a catalytic converter is juxtaposed along the oil pan and inserted in an intermediate portion of the exhaust passage.

With the above arrangement, the catalytic converter is mounted in that portion of the upper area within the engine body case which is near the engine mounting area and which has a relatively large width. Therefore, the catalytic converter is easy to place.

Further, the catalytic converter can be simply and firmly supported within the engine case by fixing the catalytic converter to an extension integral with the oil pan, and it is easy to connect the catalytic converter to the exhaust passage.

The above and other objects, features and advantages of the present invention will become apparent from the following description of a preferred embodiment taken in conjunction with the accompanying drawings.

DESCRIPTION OF THE PREFERRED EMBODIMENT

Figure 1:
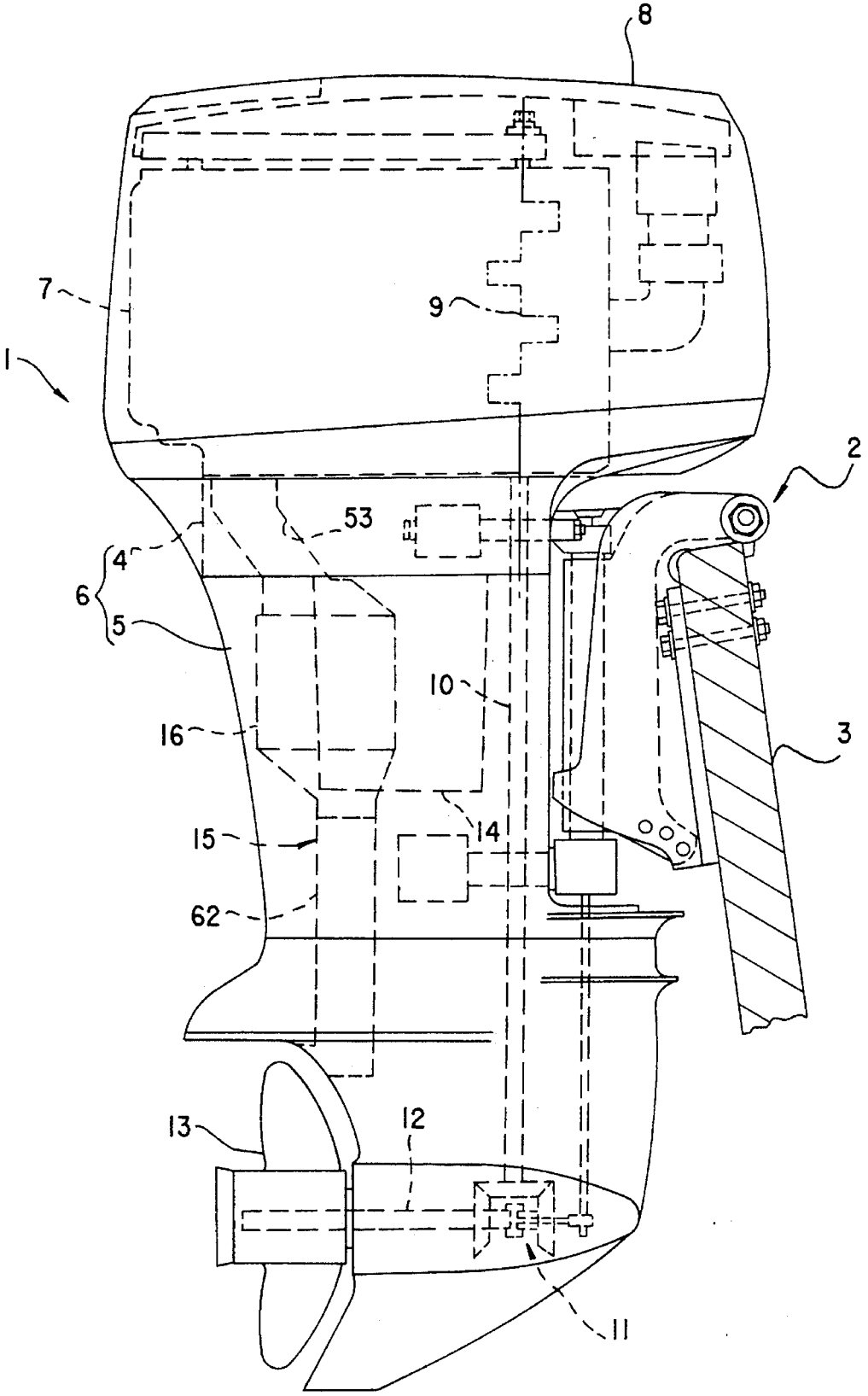
FIG. 1 is a side view of an outboard engine structure which includes the present invention.

Referring to FIG. 1, an outboard engine structure 1 is mounted at a stern 3 of a boat or ship through a mounting fixture 2. The outboard engine structure 1 includes an engine body case 6 which comprises an engine mount case 4 and an extension case 5. An engine 7 is mounted on an upper portion of the engine body case 6 and covered at its primary portion by an engine cover 8.

The engine will be described hereinafter. A crankshaft 9 of the engine is directed vertically, and a drive shaft 10 is connected to the crankshaft 9 and extends downwardly within the engine body case 6. The drive shaft 10 is connected at its lower end to a propeller shaft 12 through a clutch and gear device 11 for moving the boat forward and backward. A propeller 13 is rotatably driven by engine power transmitted thereto through the crankshaft 9, the drive shaft 10, the clutch and gear device 11 and the propeller shaft 12.

Further, an oil pan 14 for the engine 7 is suspended within the engine body case 6 at its upper portion. An exhaust passage 15 is connected to an exhaust bore in the engine 7 and extends vertically within the engine body case 6. The lower end of the exhaust passage 15 opens rearwardly in the vicinity of the propeller 13, so that exhaust gas from the engine 7 is discharged into water. A catalytic converter 16 is inserted in an intermediate portion of the exhaust passage 15 and is disposed outside the oil pan 14 to extend along the oil pan. The detailed structures of the oil pan 14, the exhaust passage 15 and the catalytic converter 16 will be described hereinafter.

Figure 2:
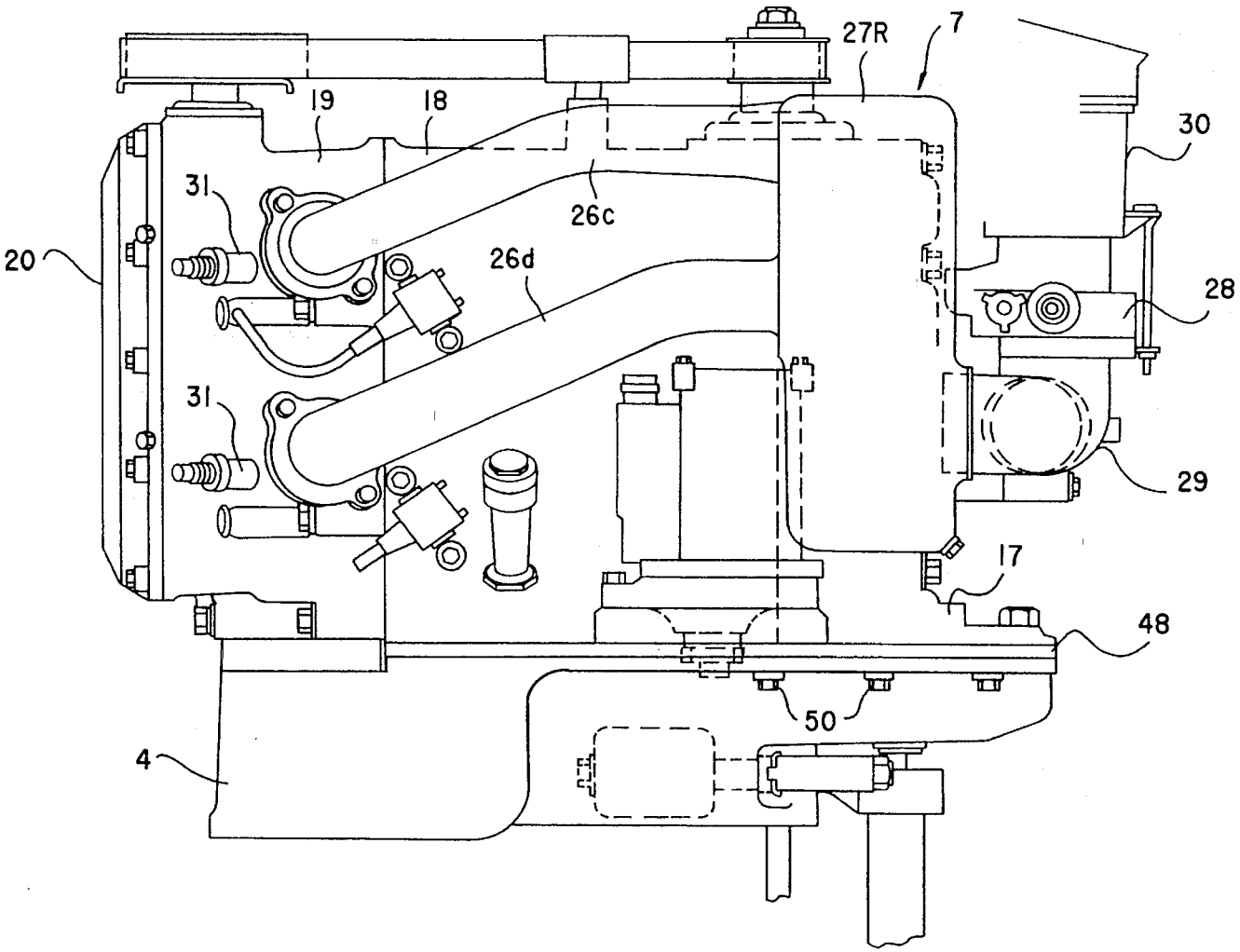
FIG. 2 is a right side view of an engine.
Figure 3:
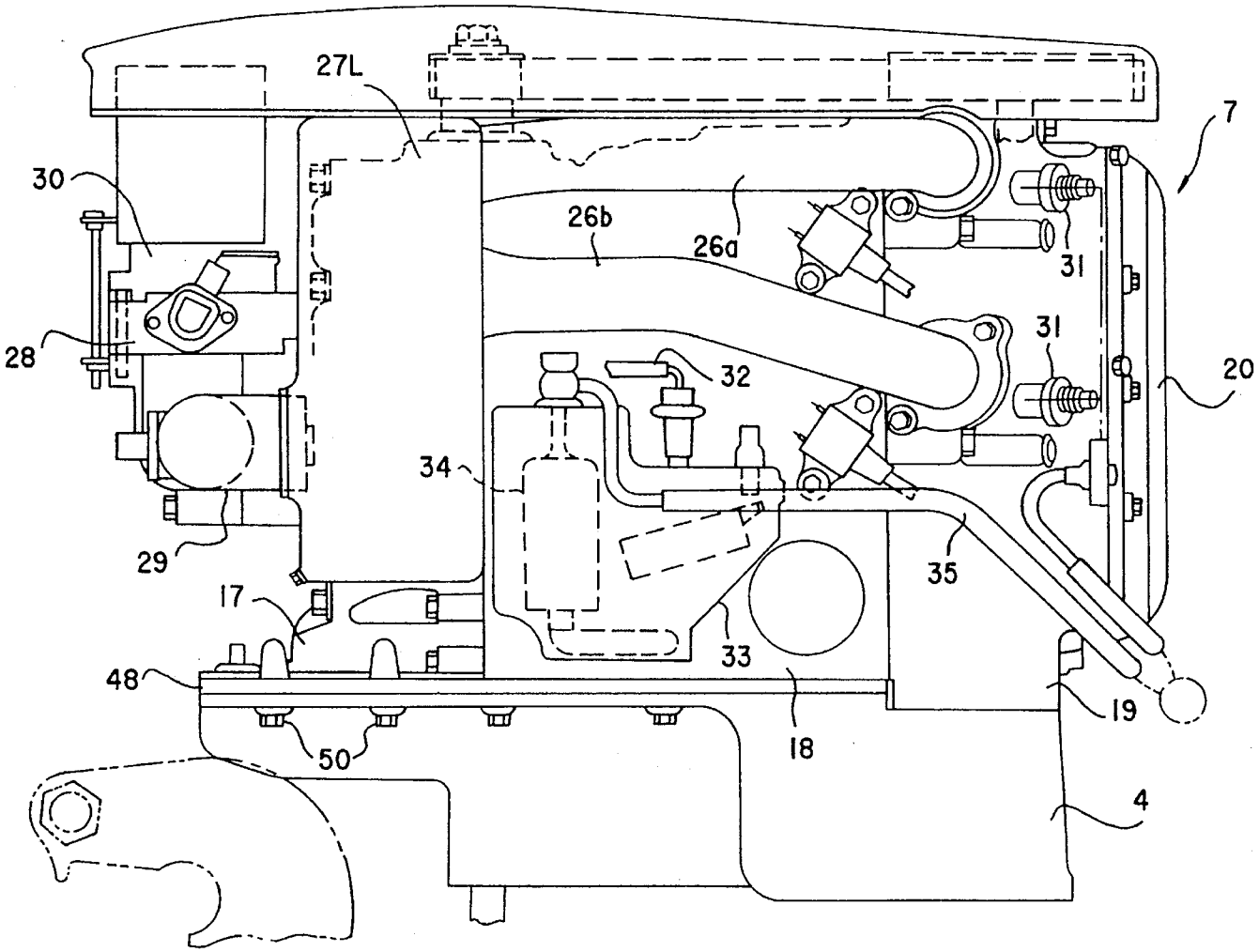
FIG. 3 is a left side view of the engine.
Figure 4:
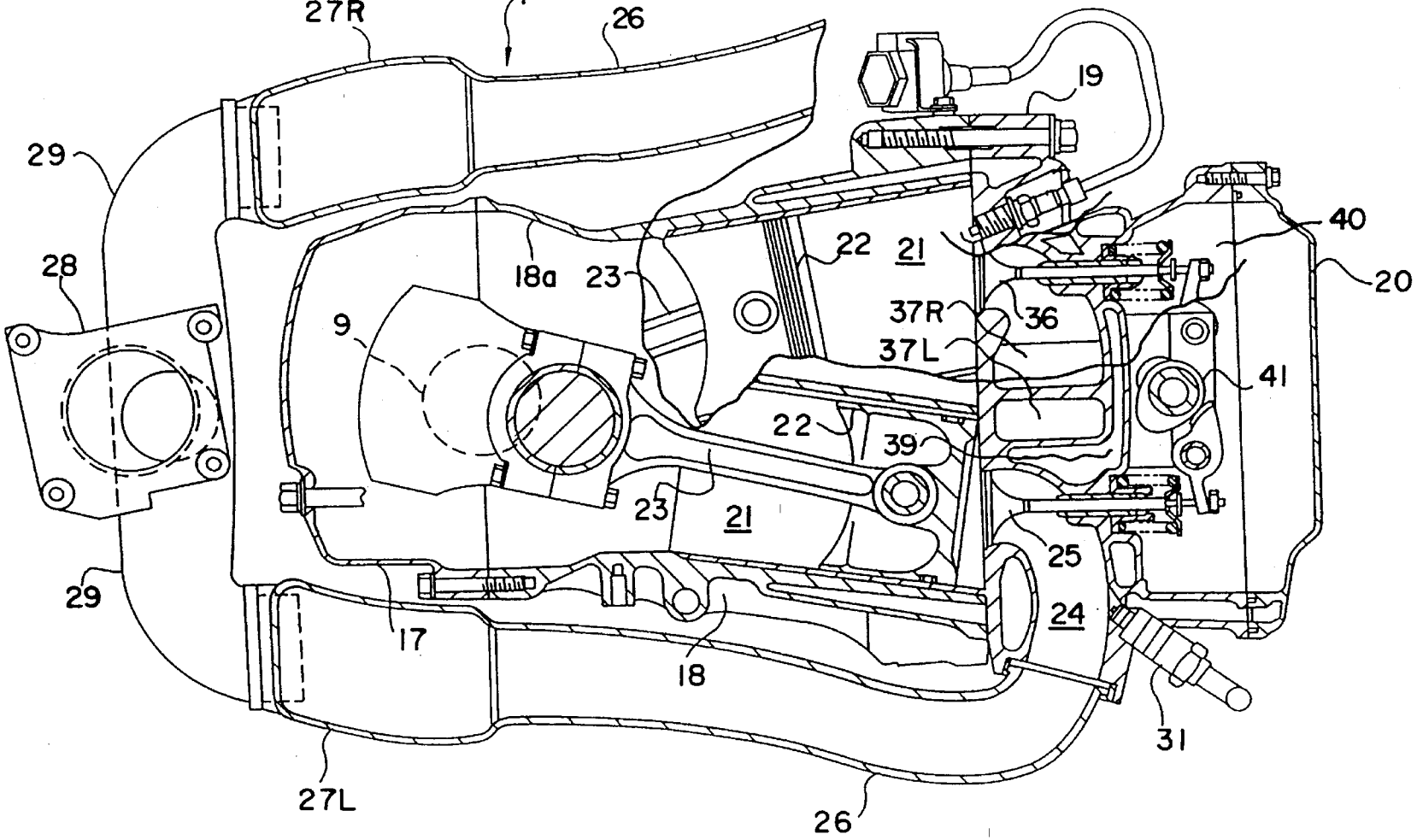
FIG. 4 is a cross-sectional view of the engine.

FIG. 2 is a right side view of the engine 7; FIG. 3 is a left side view of the engine; and FIG. 4 is a cross-sectional view of the engine. The terms "left" and "right" mean left and right when the outboard engine structure is mounted on the stern 3 of the boat or ship as shown in FIG. 1 as viewed forwardly from rear (rightwardly from the left in FIG. 1).

A body of the engine 7 as its primary portion includes a crankcase 17, a cylinder block 18, a cylinder head 19 and a cylinder head cover 20. The cylinder block 18 is integrally provided with a skirt 18*a* forming a portion of the crankcase 17, as shown in FIG. 4. Two sets of pairs of cylinders 21 are disposed within the cylinder block 18, in a lateral V-shaped configuration. Pistons 22 in the cylinders 21 are connected to the single crankshaft 9 through connecting rods 23.

Figure 5:
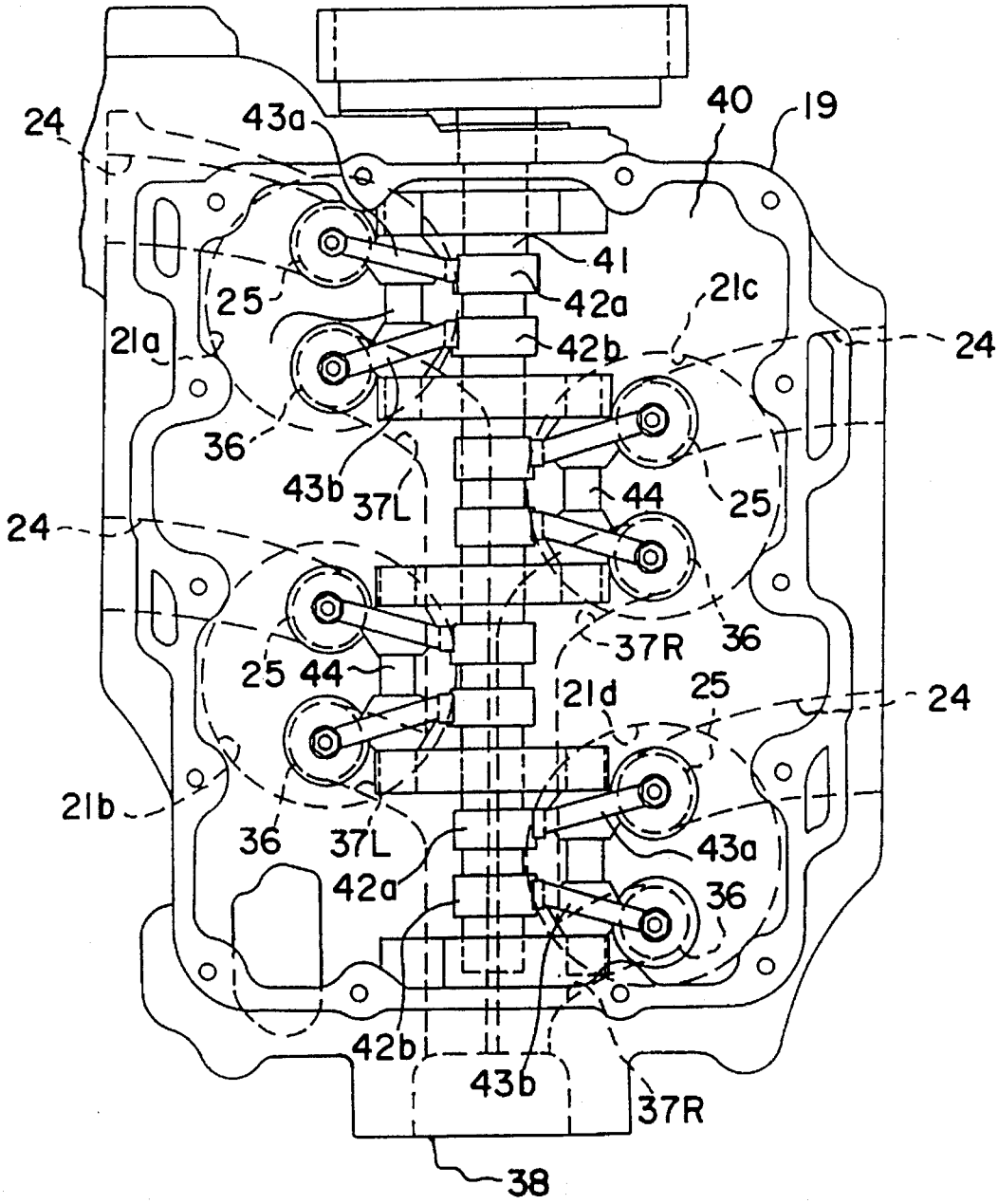
FIG. 5 is an end view of a cylinder head on the side of a cylinder head cover.

FIG. 5 is an end view of the cylinder head 19 on the side of the cylinder head cover 20. The arrangement of the cylinders 21 are also shown in FIG. 5. As can be seen from FIG. 5, there are four cylinders 21: a pair of cylinders 21*a* and 21*b* vertically arranged at a left side, and another pair of cylinders 21*c* and 21*d* arranged vertically at a right side. These cylinders 21 are arranged in a zigzag manner with the left cylinders 21*a* and 21*b* being higher in level than the right cylinders 21*c* and 21*d*. Such an arrangement of the cylinders ensures that the lateral width of the cylinder block 18 can be reduced to reduce the size of the entire engine 7.

Intake passages 24 are provided in the cylinder head 19 in correspondence with the cylinders 21, as shown in FIG. 4 for the lower cylinder 21. These intake passages 24 lead to the corresponding cylinders 21 through intake valves 25 and open at their other ends into lateral opposite sides of the cylinder head 19. Intake pipes 26 are connected to the openings of the intake passages 24, respectively, and extend forwardly along the lateral opposite side of the cylinder block 18. The intake pipes 26*c* and 26*d* shown in FIG. 2 are intake pipes corresponding to the cylinders 21*c* and 21*d* shown in FIG. 5, while the intake pipes 26*a* and 26*b* shown in FIG. 3 are intake pipes corresponding to the cylinders 21*a* and 21*b* shown in FIG. 5.

Surge tanks 27L and 27R are provided on the laterally opposite sides of a front portion of the cylinder block 18. The intake pipes 26*a* and 26*b* are connected to the surge tank 27L, while the intake pipes 26*c* and 26*d* are connected to the surge tank 27R. A throttle body 28 having a throttle valve therein is disposed on a front, central portion of the crankcase 17, and is in communication with the surge tanks 27L and 27R through an air passage 29 which diverges laterally from the throttle body 28.

Air is introduced from above through an air introducing pipe 30 into the throttle body 28. Such air is adjusted in flow rate within the throttle body 28 by the throttle valve, and then distributed into the left and right surge tanks 27L and 27R and supplied as combustion air through the intake pipes 26 into the corresponding cylinders 21. Fuel is injected from a fuel injection nozzle 31 and is mixed with the air in the intake passage 24.

The fuel is supplied from a fuel tank mounted on a side of the boat or ship. The fuel supply system includes a fuel receiving pipe 32, a gas-liquid separator 33, a fuel pump 34, a fuel supply pipe 35 which are connected to the fuel tank mounted on the boat or ship. The fuel supply system is disposed at a left portion of the cylinder block 18.

As shown in FIG. 5 and as shown for the left cylinders 21 in FIG. 4 (upper ones in FIG. 4), exhaust valves 36 are mounted below the intake valves 25 for the cylinders 21, respectively. Exhaust passages 37R and 37L are defined in the cylinder head 19. The exhaust passages 37R are connected to the exhaust valves 36 for the right cylinders 21, and the exhaust passages 37L are connected to the exhaust valves 36 for the left cylinders 21. The exhaust passages 37L and 37R extend vertically through a widthwise central portion of the cylinder head 19, and are joined together at their lower ends to open as an exhaust portion 38 in a lower surface of the cylinder head 19. Water jackets 39 are defined around the exhaust passages 37L and 37R to surround them.

FIG. 5 also shows a valve operating mechanism disposed in a valve operating chamber 40 in the cylinder head 19. More specifically, a cam shaft 41 is disposed vertically in a central portion of the valve operating chamber 40, and a rocker arm 43*a* for each intake valve 25 and a rocker arm 43*b* for each exhaust valve 36 are in engagement with cams 42*a* and 42*b* provided on the cam shaft 41. Reference numeral 44 is the rocker arm shaft.

Figure 6:
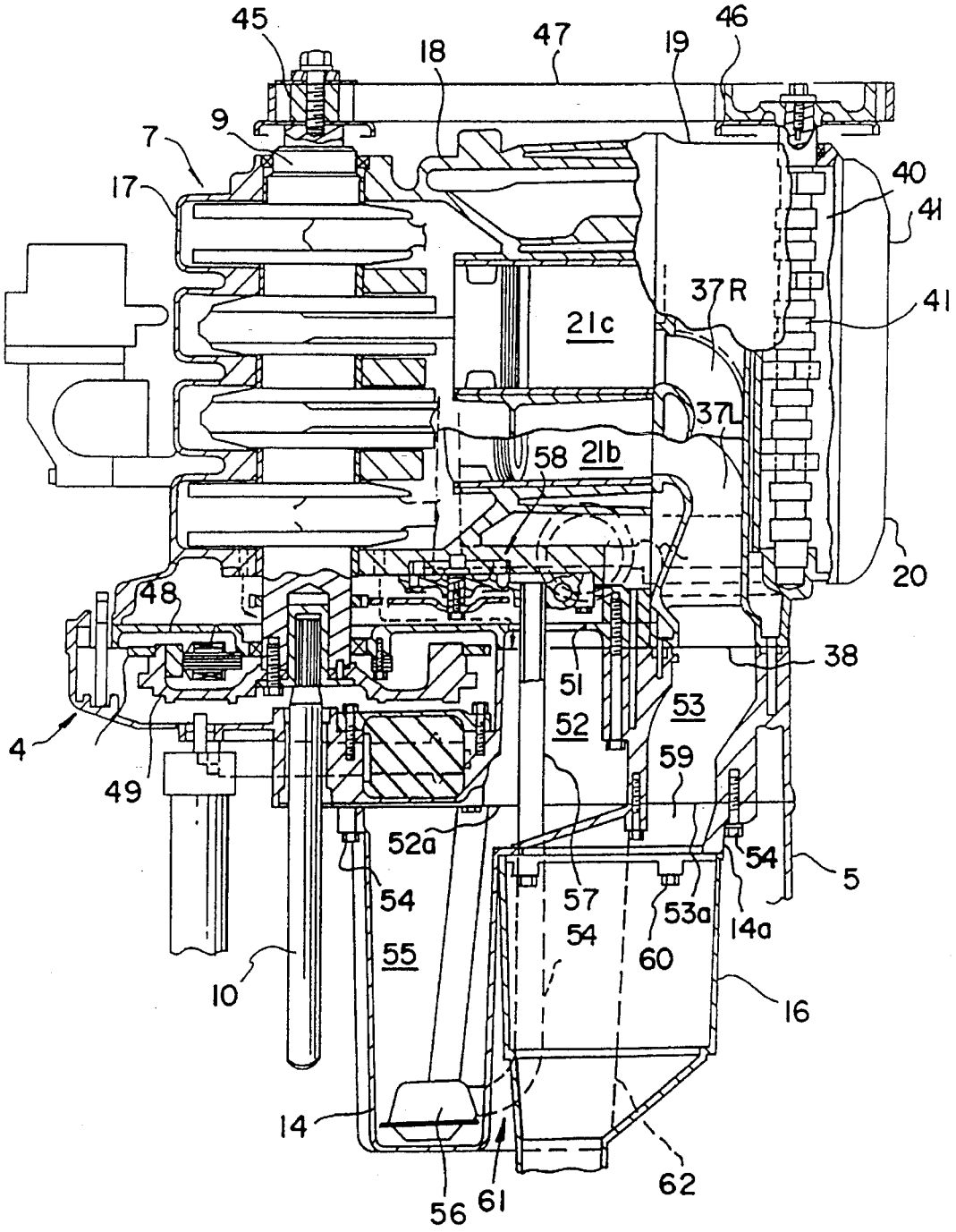
FIG. 6 is a vertical sectional view of the engine taken in various sections including an axis of a crankshaft.

FIG. 6 is a vertical sectional view taken in various sections including an axis of the crankshaft 9 of the engine 7, with a section of the cylinder 21*c* and a section of the cylinder 21*b* being partially shown.

The crankshaft 9 is directed vertically, as described above, and the cam shaft 41 is disposed parallel to the crankshaft 9 in the valve operating chamber 40 of the cylinder head 19. The crankshaft 9 and the cam shaft 41 project upwardly through the engine body, and have pulleys 45 and 46 fixedly mounted at the upper end thereof, respectively. A cam driving belt 47 is reeved around the pulleys 45 and 46.

Lower surfaces of the cylinder block 18 and the crank case 17 are opened. A lower wall is formed by a closing plate 48 for sealingly closing the open portions. A lower end of their crankshaft 9 is rotatably passed through the closing plate 48 and projects downward. A flywheel 49 is secured to the lower end of the crankshaft 9. The drive shaft 10 is also connected to the lower end of the crankshaft 9 and extends downward.

The engine mount case 4 is coupled to the lower surfaces of the cylinder block 18 and the crank case 17 by bolts 50, with the closing plate 48 interposed therebetween (FIGS. 2 and 3). The engine 7 is mounted on the extension case 5 through the engine mount case 4. The engine mount case 4 further extends rearwardly and is also connected to the lower surface of the cylinder head 19 which has the exhaust port 38.

The flywheel 49 is accommodated in the engine mount case 4. The engine mount case 4 further has an oil passage 52 communicating with interiors of the cylinder block 18 and the crankcase 17 through an opening 51 provided in the closing plate 48. An exhaust passage 53 is provided in the engine mount case 4 and connected to the exhaust port 38 in the cylinder head 19. The oil passage 52 and the exhaust passage 53 are defined in the engine mount case 4 in a divided relation to each other and open at the lower surface of the engine mount case 4 through openings 52*a* and 53*a*, respectively.

The oil pan 14 is mounted in the suspended manner on the lower surface of the engine mount case 4 within the extension case 5 by fastening the peripheral edge of its upper end with bolts 54. The oil pan 14 has an oil reservoir chamber 55 which is in communication with the oil passage 52 through the opening 52*a*. Oil on the closing plate 48 is passed through the opening 51 and the oil passage 52 and drops into the oil reservoir chamber 55. The oil in the oil reservoir chamber 55 is drawn through a strainer 56 and an intake pipe 57 into an oil pump 58 and then pumped to various portions of the engine by the pump 58.

The oil pan 14 is provided at its upper portion with an extension portion 14*a* which extends rearwardly along the lower surface of the engine mount case 4 and covers the opening 53*a* of the exhaust passage 53. The extension 14*a* has an exhaust passage portion 59 defined therein, which communicates with the exhaust passage 53 through the opening 53*a* and opens into the lower surface of the extension 14*a*. The exhaust passage portion 59 and the oil reservoir chamber 55 are isolated from each other.

The catalytic converter 16 having an exhaust emission control catalyst contained therein, is fastened and fixed to the lower surface of the extension 14*a* of the oil pan 14 by bolts 60 with its upper opening matched to an opening of the exhaust passage portion 59. A recess 61 is defined in an outside of the oil pan 14, so that the catalytic converter 16 can be accommodated. An exhaust pipe 62 is connected to an outlet provided at a lower portion of the catalytic converter 16 supported on the oil pan 14, and extends downwardly within the extension case 5. The exhaust pipe 62 forms a portion of the exhaust passage 15 shown in FIG. 1 which is located downstream from the catalytic converter 16. A portion of the exhaust passage 15 located upstream of the catalytic converter 16 is formed by the exhaust passage 53 and the exhaust passage portion 59. Exhaust gas from each cylinder 21 passes through the exhaust passages 37L and 37R defined in the cylinder head 19, the exhaust passage 53 defined in the engine mount case 4 and the exhaust passage portion 59 defined in the extension 14*a* of the oil pan 14 into the catalytic converter 16, where the exhaust gas is purified and then passes through the exhaust pipe 62 and discharged from the lower portion of the extension case 5 into the water.

In the above embodiment according to the present invention, the catalytic converter 16 is mounted in that portion of the upper area within the engine body case 6 which is relatively wide near the engine mounting area, as described above, and therefore, the catalytic converter 16 is easy to place.

Further, since the catalytic converter 16 is fixed to the extension position 14*a* integral with the oil pan 14 by the bolts 60, the catalytic converter 16 can be simply and firmly supported within the engine body case 6 and easily connected to the exhaust passage in the above manner.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims, are therefore, to be embraced therein.

We claim:

1. An outboard engine structure comprising:

(a) an engine body case;

(b) an engine body mounted on an upper portion of said engine body case;

(c) an exhaust passage means vertically oriented in said engine body case, for carrying exhaust gas from said engine and discharging the exhaust gas into water;

(d) an oil pan mounted within an upper portion of said engine body case; and (e) a catalytic converter mounted in said exhaust passage means within said engine body case positioned adjacent said oil pan.

2. An outboard engine structure as set forth in claim 1, wherein said oil pan includes an extension portion integrally formed thereon, and wherein said catalytic converter is fixed to and supported on said extension portion.

3. An outboard engine structure as set forth in claim 1, wherein said exhaust passage means includes an upstream portion extending from said engine to said catalytic converter and a downstream portion extending from said catalytic converter to an exhaust opening into the water.

4. An outboard engine structure comprising:

(a) an engine which comprises a cylinder head, a cylinder block, and a crankcase which are assembled together, said cylinder head being disposed at a rear portion of the outboard engine structure;

(b) an engine cover for covering said engine therein;

(c) an engine body case;

(d) an oil pan disposed in said engine body case; and (e) a catalytic converter disposed in said engine body case, wherein said engine is disposed in an engine room defined in said engine cover, separated from an inside of said engine body case, and wherein said oil pan and said catalytic converter are positioned side by side relative to each other such that a first portion of said oil pan is on a front side in the engine body case and a first portion of said catalytic converter is on a rear side in the engine body case and such that a second portion of said oil pan and a second portion of said catalytic converter are overlapped with each other in a lateral direction of the outboard engine structure.

5. An outboard engine structure comprising:

(a) an engine which comprises a cylinder head, a cylinder block, and a crankcase which are assembled together;

(b) an engine cover for covering said engine therein;

(c) an engine body case;

(d) an oil pan disposed in said engine body case; and (e) catalytic converter disposed in said engine body case, wherein said engine is disposed in an engine room defined in said engine cover, said engine room being separated from an inside of said engine body case wherein said oil pan is provided with a recess and said catalytic converter is accommodated in said recess.

6. An outboard engine structure as set forth in claim 5, wherein said recess is open rearwardly of said outboard engine structure.

7. An outboard engine structure as set forth in claim 4, 5 or 6, wherein said oil pan has an oil reservoir portion and a space is provided between said oil reservoir portion and said catalytic converter.

8. An outboard engine structure as set forth in claim 4, 5, or 6, wherein said oil pan includes an extension portion integrally formed thereon, and wherein said catalytic converter is fixed to and supported on said extension portion.

9. An outboard engine structure as set forth in claim 7, wherein said oil pan includes an extension portion integrally formed thereon, and wherein said catalytic converter is fixed to and supported on said extension portion.

10. An outboard engine structure as set forth in claim 8, wherein said extension portion is disposed at an upper portion of said oil pan.

11. An outboard engine structure as set forth in claim 9, wherein said extension portion is disposed at an upper portion of said oil pan.

12. An outboard engine structure as set forth in claim 8, wherein said engine body case comprises an engine mount case for supporting said engine thereon and an extension case connected to a lower portion of said engine mount case, and wherein said extension portion is fixed to said engine mount case.

13. An outboard engine structure as set forth in claim 9, wherein said engine body case comprises an engine mount case for supporting said engine thereon and an extension case connected to a lower portion of said engine mount case, and wherein said extension portion is fixed to said engine mount case.

14. An outboard engine structure as set forth in claim 10, wherein said engine body case comprises an engine mount case for supporting said engine thereon and an extension case connected to a lower portion of said engine mount case, and wherein said extension portion is fixed to said engine mount.

15. An outboard engine structure as set forth in claim 11, wherein said engine body case comprises an engine mount case for supporting said engine thereon and an extension case connected to a lower portion of said engine mount case, and wherein said extension portion is fixed to said engine mount.

* * * * *